US008627952B2

(12) United States Patent
Glinert et al.

(10) Patent No.: US 8,627,952 B2
(45) Date of Patent: Jan. 14, 2014

(54) PACKAGING AND DISPLAY SYSTEM

(75) Inventors: Kenneth Glinert, Chappaqua, NY (US); Mark Campbell, Plainfield, IL (US)

(73) Assignee: Multi Packaging Solutions, Inc., Lansing, MI (US)

( * ) Notice: Subject to any disclaimer, the term of this patent is extended or adjusted under 35 U.S.C. 154(b) by 0 days.

(21) Appl. No.: 13/084,672

(22) Filed: Apr. 12, 2011

(65) Prior Publication Data

US 2012/0091020 A1 Apr. 19, 2012

Related U.S. Application Data

(60) Provisional application No. 61/323,378, filed on Apr. 13, 2010.

(51) Int. Cl.
*A47F 7/00* (2006.01)
*B65D 85/00* (2006.01)

(52) U.S. Cl.
USPC ..... 206/315.9; 211/14; 248/121; 248/316.3

(58) Field of Classification Search
USPC ..... 206/315.9, 315.91, 315.1; 211/14; 248/316.2, 316.3, 121, 230.7
See application file for complete search history.

(56) References Cited

U.S. PATENT DOCUMENTS

| | | | | | |
|---|---|---|---|---|---|
| 3,231,993 | A | * | 2/1966 | Levy | 40/493 |
| 3,559,935 | A | * | 2/1971 | Gardner | 248/125.8 |
| 3,777,933 | A | * | 12/1973 | Joliot | 221/309 |
| 3,987,893 | A | * | 10/1976 | Hanson | 206/779 |
| 4,632,245 | A | * | 12/1986 | Lerner | 206/315.1 |
| 4,691,824 | A | * | 9/1987 | Schindler | 206/315.9 |
| 4,779,726 | A | | 10/1988 | Pratt | |
| 5,232,101 | A | | 8/1993 | Shaftner | |
| 5,322,210 | A | | 6/1994 | Chila et al. | |
| 5,379,892 | A | * | 1/1995 | Reams et al. | 206/315.9 |
| D363,520 | S | * | 10/1995 | Melillo | D3/224 |
| 6,454,105 | B1 | | 9/2002 | Medina | |
| 6,568,528 | B2 | | 5/2003 | Murray | |
| 6,601,711 | B1 | | 8/2003 | Knable, III | |
| 6,644,473 | B2 | | 11/2003 | Kohler | |
| D532,197 | S | * | 11/2006 | Niksich | D3/221 |
| 7,207,446 | B1 | * | 4/2007 | Boston | 211/14 |
| 7,500,570 | B2 | | 3/2009 | Kurcheski | |
| 2001/0023912 | A1 | * | 9/2001 | Donofrio, Jr. | 248/121 |
| 2002/0084201 | A1 | * | 7/2002 | Murray | 206/315.9 |

* cited by examiner

*Primary Examiner* — Jacob K Ackun
(74) *Attorney, Agent, or Firm* — The Dobrusin Law Firm, PC

(57) ABSTRACT

A packaging is provided for the transport, storage and display of rounded articles. The packaging may include an elongated arm, a gripping portion and a mounting portion. The packaging may be configured to be stacked onto other packagings of like structure. The packaging may also be configured for mounting to a vertical surface.

15 Claims, 5 Drawing Sheets

PACKAGING AND DISPLAY SYSTEM

CLAIM OF PRIORITY

This application claims the benefit of the filing date of U.S. Provisional Application Ser. No. 61/323,378 filed on Apr. 13, 2010, the entirety of the contents of that application being hereby expressly incorporated by reference.

FIELD OF THE INVENTION

The present invention relates generally to packaging for spherical or rounded articles, and more specifically to stackable packaging for ball objects that employs a relatively low amount of packaging materials while providing a stackable and mountable packaging structure for use in either or both of shipping and displaying of articles.

BACKGROUND OF THE INVENTION

The packaging of articles, such as ball objects, having curved or rounded features and minimal or no flat surfaces presents a number of challenges. Generally, articles are packaged in a way that minimizes packaging material and associated costs by designing packaging that has a shape similar to the articles placed within the packaging. However, by packaging a curved article in a correspondingly curved package, the packages are rarely stackable and the packages may also be likely to shift and move during storage, shipping and/or display. As a result, rounded articles are often placed into generally box-like packaging materials having squared (e.g., angular) corners or folded edges so that the packaging rests on one or more flat surfaces during shipping, storage and display, and is spaced from an adjoining package by a space including that occupied by the corners. Thus, in order to create a flat surface for purposes of stacking the articles as required for effective shipping, storage and retail display, substantial amounts of extra packaging material and additional empty packaging space are often required. The empty packaging space that results from packaging a rounded article in a generally box-like package having angular corners and/or folded edges is also particularly susceptible to crushing (e.g., at corners having empty space not filled by any article) and deformation during the storing, shipping and/or display process. Any deformed or damaged packages are less attractive for retail display and may be less likely to sell the enclosed article given that customers may assume that the enclosed article has been somehow damaged.

In addition to the challenges presented above with regard to the use of generally box-like squared packaging for rounded objects, retail display issues are also of concern. Angular cornered and/or folded edge packaging typically will employ a horizontal support surface such as a shelf. Boxes can be stacked or placed onto shelves, but a horizontal support surface is almost always required. Further, as the number of products and brands continues to increase, many retail establishments are forced to limit display sizes. The number of articles that can be displayed for sale is often limited by pre-existing shelf space and inventory warehouse storage frequently needed, typically again in a shelf-storage arrangement. Larger packaging may limit the number of articles that may fit within a display, thus providing motivation to limit packaging size in an effort to maximize the number of articles that can fit in a given display area.

Yet another issue with the packaging of rounded articles (and many other types of articles commonly packaged in paper-based packaging) pertains to product returns. Once an article is purchased, most standard paper-based packagings become destroyed or at least damaged so that the packaging cannot be effectively replaced into its original functioning form. Specifically, in the case of packaging commonly associated with, rounded athletic equipment (e.g., basketballs, baseballs, footballs, golf balls, soccer balls, volleyballs and the like), once a consumer removes the equipment from its packaging (or if a packaging is damaged prior to purchase) it is often impossible to return the article to within the packaging without some damage to the packaging or indication that the packaging has been opened. In this regard, traditional packaging for many articles, such as inflatable ball objects is disposable. The packaging serves a single purpose during its life and upon consumer purchase it is irreversible destroyed and unable to serve any later purpose.

An additional consideration related to the packaging of inflatable balls is the desire to use packaging that allows the ball to be visible so that a consumer can see the ball within the packaging. Thus, inflatable balls are often packaged so that logos and brand names printed onto the balls are visible to consumers viewing the packaging. It is thus desirable that the inflatable balls do not spin within the packaging so that logos and brand names are not obscured from consumer view. It is further desirable that a packaging allows for the provision of product information on or attached to the packaging.

As examples of traditional packaging for a rounded article, U.S. Pat. Nos. 4,779,726; 5,322,210; and 6,644,473 each disclose angular (e.g., squared) packagings, generally for use with balls. The drawings associated with each of these packagings include box-like coverings which create at least one flattened surface for stacking and shelving.

U.S. Pat. No. 6,568,528 discloses a folded display container for use with spherical articles. The packaging appears to make use of less packaging material by limiting the size of the box-like packaging.

As examples of ball display/storage units, U.S. Pat. Nos. 7,207,446 and 7,500,570 disclose mountable ball holders. The structures appear to be limited to certain applications.

Accordingly, in view of the above, there exists a need for product packaging which overcomes some or all of the above drawbacks in the art. For example, there is a need for a packaging that reduces the overall packaging material and empty space that is so often associated with packaging for rounded articles. There is also a need for a product packaging that allows for maintaining articles in a stacked arrangement without requiring squared corners and/or folded edges to create a flat surface. Further, there is a need for product packaging that facilitates unique display capabilities. There is also a need for packaging that can be easily replaced to its original form after the articles have been removed for purposes of effective re-packaging. There is a further need for packaging having useful applications beyond the time of consumer purchase and removal of the article from the packaging. There is also a need for a packaging that allows for inclusion or attachment of printed material relating to the article located within the packaging.

SUMMARY OF THE INVENTION

The present invention meets some or all of the above needs by providing a ball packaging that includes an elongated arm, a gripping portion and a mounting structure. The elongated arm may be configured to partially surround a ball inserted into the packaging. The elongated arm may include a first end portion and a second end portion. One or more of the first end portion and second end portion of the elongated arm may include one or more gripping portions. The one or more gripping portions may include a first gripping portion having a gripping contact surface located proximate the first end portion of the arm. A second gripping portion may be located proximate the second end portion of the arm and in generally axially opposing relationship with the first gripping portion. The first and second gripping portions may be configured for gripping a ball and securing it in place, which optionally may be absent any further stabilizing structure. The mounting structure may be located on the arm between the first and second gripping portions. The mounting structure may have a width that is approximately the width of the arm at its largest width along the arm.

In another aspect, the present invention provides for a ball packaging including a stressing portion, a top gripping portion, a bottom gripping portion and a mounting portion. The stressing portion may induce a stress state in the ball packaging when a ball is introduced therein. The top gripping portion and bottom gripping portion may each be located toward an end of the stressing portion so that the gripping portions apply pressure to a ball for maintaining the ball in a generally fixed position. The mounting portion may be located on the stressing portion for attaching the ball packaging to an adjoining structure and maintaining the ball in a generally suspended relation from any adjoining structure.

As can be appreciated from the above summary and the remaining teachings herein, the packaging of the present invention offers any of a number of benefits and advantages. The amount of packaging used to ship, store and display the articles may be reduced as compared to traditional box-like packaging. The packaging may allow for simplified stacking but contains no empty package space to facilitate the stacking. The packaging may easily be removed from an article and replaced and/or employed in a subsequent additional use. The packaging may be able to avoid crushing and/or other damage as often occurs with standard paper-based packaging materials. The packaging may be mounted onto any vertical surface to allow for creative retail display, or storage by a purchasing consumer.

DETAILED DESCRIPTION

Figure 1:
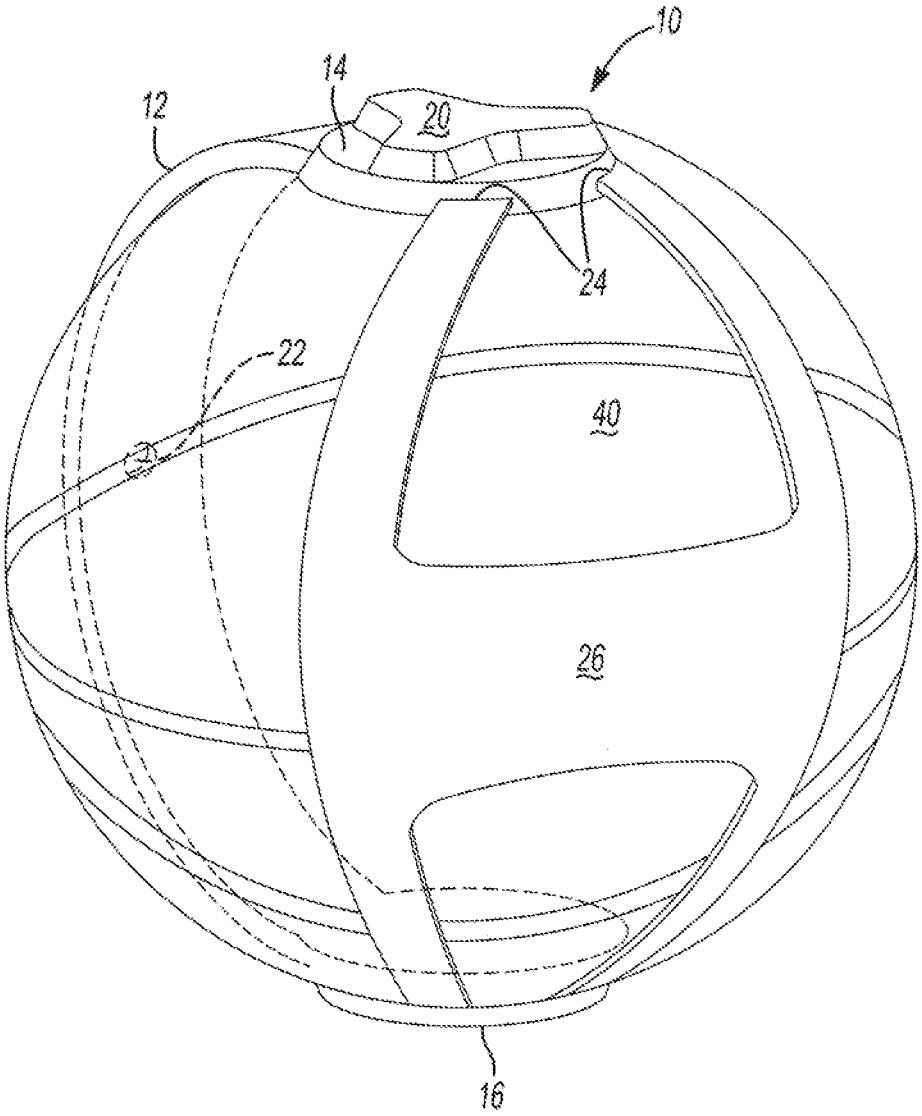
FIG. 1 is a perspective view of an illustrative example of the packaging of the present invention.

In general, the invention described herein provides for a packaging that includes an elongated arm, a gripping structure and a mounting structure. The elongated arm may also be described as a stressing portion. The gripping structure may include a first and second gripping portion (e.g., a top and bottom gripping portion). Also provided herein, is a method for shipping and displaying the packagings of the present invention. In general, various of the advantages herein may be possible by situating a mounting structure along the elongated arm.

Advantageously, the packaging may be formed so that the gripping structure includes first and second gripping portions. The first and second gripping portions may be aligned generally axially with each other. The first and second gripping portions may lie in a common plane. The ball packaging may be symmetrical about at least two axes. The packaging may be formed so that during attachment to an adjoining structure, the elongated arm is vertically aligned and the first and second gripping portions are aligned along an axis generally parallel to the adjoining structure. The elongated arm may be generally arcuate with a substantially constant cross-sectional profile between the first and second gripping portions. The mounting structure may be integrally formed in the arm.

The first gripping portion (e.g., the top gripping portion) may be configured for engaging a second gripping portion (e.g., the bottom gripping portion) of an adjacent ball packaging. The bottom gripping portion may be configured for engaging the top portion of an adjacent ball packaging. The top gripping portion and bottom gripping portion may be configured to allow for stacking with additional ball packagings of like structure. The top gripping portion and bottom gripping portion may include structures that allow for a connection between two or more packagings so that the connection provides for balanced and secure stacking of packagings.

The packaging may be formed so that the gripping portions function for horizontally supporting a ball. The gripping portions may also be suspended from a vertical wall in the absence of any additional horizontal support structure. The packaging may be formed so that the function of the stressing portion and gripping portions relies on the elasticity of the material used to form the stressing portion and gripping portions. The stressing portion and gripping portions may exert sufficient force on a ball so that the ball does not rotate within the packaging during shipment or display.

In another aspect, the present invention contemplates a method for shipping a plurality of ball packagings, each having a ball therein. Specifically, the method includes the steps of providing a plurality of balls for shipment, packaging each ball in a ball packaging, stacking the plurality of balls for shipment and shipping the plurality of stacked balls. As further described herein, the ball packagings may include an elongated arm, a top gripping portion having a protruded area and a bottom gripping portion having a cavity formed within that corresponds in shape to the protruded area of the top gripping portion.

The present invention further contemplates a method for displaying a plurality of balls in a retail setting comprising the steps of receiving a plurality of balls, each within a ball packaging, and displaying the packaged balls. The displaying of the packagings may be facilitated by the ball packaging including an elongated arm, a top gripping portion having a protruded area, a bottom gripping portion in generally axially opposing relationship with the top gripping portion and having a cavity formed within that corresponds in shape to the protruded area of the top gripping portion and a mounting structure located on the arm between the top gripping portion and bottom gripping portion. The ball packagings may then be displayed so that the cavities of the bottom gripping portions engage the protruded areas of the top gripping portions of adjacent ball packagings.

Also contemplated within the scope of the teachings herein is a display including one or more ball packagings located onto a vertical surface via the mounting structure. A display may include both stacked ball packagings and mounted ball packagings. A display may include ball packagings that are both stacked and mounted to a vertical surface for added stability.

The teachings of the present invention contemplate the employment of an elongated arm structure that is configured to include gripping portions and a mounting portion between the gripping portions. The elongated arm is configured to partially surround (e.g., from about 45° to about 315° of the circumference of the article) the article and maintain the article in the packaging via the gripping portion. The elongated arm may include a first end portion and a second end portion and may be generally vertically aligned. The elongated arm may be generally arcuate and may have a substantially constant cross-sectional profile. The elongated arm may be configured to partially surround articles placed within the packaging so that the arm extends no greater than 180° about any articles within the packaging. The elongated arm may comprise a stressing portion for inducing a stress state in the packaging when articles are placed therein. The elongated arm (e.g., the stressing portion) may exert sufficient force upon articles within the packaging so that the articles are maintained within the packaging.

The elongated arm (e.g., stressing portion) may also include a gripping structure. The gripping structure may include a first gripping portion located proximate the first end of the elongated arm and a second gripping portion located proximate the second end of the elongated arm. The gripping structure may include only the first and second gripping portions. The first and second gripping portions may lie in a common plane. The first and second gripping portions may both include a gripping contact surface for contacting any articles contained within the packaging. The first gripping portion may be arranged so that it generally opposes the second gripping portion. The gripping structure (e.g., the first and second gripping portions) may be configured for gripping any articles within the packaging and securing those articles within the packaging absent any additional stabilizing structure. The gripping portions may also apply pressure to any articles within the packaging so that those articles are maintained within the packaging and do not shift within the packaging. The gripping portions may allow for articles to be suspended from a vertical surface in the absence of any additional horizontal support structure. The gripping portions may function to horizontally support articles within the packaging. The gripping portions may be configured to allow stacking of multiple packagings. The first gripping portion (e.g., top gripping portion) may be configured so that it engages the second gripping portion (e.g., bottom gripping portion) of an adjacent packaging, thereby allowing one packaging to be placed directly on top of a second packaging.

The elongated arm may also include a mounting structure located thereon. The mounting structure may be integrally formed with the elongated arm. The mounting structure may be located between the first and second gripping portions. The width of the mounting structure may be equal to the width of the elongated arm at its widest point. The mounting structure may include an aperture. The aperture may be configured receive a securing structure that allows for the packaging to be mounted on a vertical surface via the aperture. The securing structure may include one or more screws, nails, clips, fasteners or any similar structure that can be placed through the aperture so that the packaging is securely suspended from a vertical surface. The securing structure may further be reusable, so that a packaging may be mounted to a vertical surface via the securing structure and later removed from the vertical surface and re-mounted elsewhere via the securing structure. The aperture may also be of a size so that screws or nails of a wide variety of sizes may be used to mount the packagings.

The first and second gripping portions may include one or more openings (e.g., insert retention portions) for receiving inserts and thereafter preventing the inserts from dislodging. The insert retention portions may comprise one or more apertures, so that at least a portion of the inserts may be placed through the one or more apertures. The insert retention portions may further include a means for maintaining the one or more inserts within the one or more apertures so that the inserts remain in place on the packaging and do not become separated from the packaging. The insert retention portions may include a means for fastening the inserts to the packaging. The fastening means may include clips, screws or other fasteners. The fastening means may include a clamping structure that allows the insert to enter an opening but prevents removal of the insert by clamping onto the insert if any attempt is made to remove the insert. The insert may loop through an opening of an insert retention portion so that the insert remains in place. The insert retention portions may be configured so that inserts can be interchanged and/or replaced while a packaging is in use.

The inserts may include printed information such as promotional materials, logos, product specifications, or the like. The inserts may be attached to the first gripping portion, the second gripping portion, or both. The insert may include one continuous portions of material or may include multiple portions. The insert itself may provide a stress state such that the insert assists in maintaining the articles within the packaging.

The ability of the packaging to maintain articles within relies on the amount of elasticity and rigidity of the materials used to form elongated arm (e.g., stressing portion) and gripping portions. Thus, the stressing portion and gripping portions may be formed of a material that supplies sufficient rigidity for articles to be held in place by the compressive force created by the stressing portion and gripping portions. The stressing and gripping portions may be composed of the same materials or of different materials. The first gripping portion and second gripping portion may be composed of the same material or of different materials. The material of the gripping portions may be sufficiently rigid to provide a horizontal support surface upon which articles may be placed. However, the material of the stressing portion may also be sufficiently flexible so that the stressing portion can compress and exert a force in order to hold articles within the packaging. The compression of the stressing portion (e.g., the elongated arm) may cause the first gripping portion and second gripping portion to move toward one another when no articles are located within the packaging. The flexibility of the stressing portion may also facilitate the inclusion of articles having various sizes (e.g., diameters) so that sufficient compressive force may be exerted on any articles having a diameter within a given range. Thus, the flexibility of the elongated arm may allow the packaging to clamp down upon articles of varying diameter placed within the package.

Materials providing this requisite rigidity and flexibility may include polymeric materials including but not limited to thermoplastics, thermoset plastics, elastomeric containing materials or any combination thereof. Examples of polymeric and elastomeric materials that may be employed include nylon, polyvinyl chloride, polypropylene, high-density polyethylene, low-density polyethylene, linear low-density polyethylene, polyvinylidene chloride polyamide, polyester, polystyrene, polyethylene, polyethylene terephthlate, bio-based plastics/biopolymers (e.g., poly lactic acid), silicone, acrylonitrile butadiene styrene (ABS), rubber, polyisoprene, butyl rubber, polybutadiene, EPM rubber, EPDM rubber, or any combination thereof. Additional suitable materials may include bio-plastics such as those derived from wood pulpbased lignin (e.g., liquid wood), sugarcane or other petroleum-free moldable materials. These materials may be suitable for both the elongated arm and gripping portions. However, as indicated above, the elongated arm and gripping portions may or may not be composed of the same material. In addition, any insert retention portions may also be composed of any materials listed above. The insert retention portions may be composed of the same material as the gripping portions, or may be composed of a different material.

As discussed herein, the mounting structure may be integrally formed with the elongated arm. As such, the mounting structure may be composed of the same material as the elongated arm. However, the mounting structure may also include additional materials and/or areas of reinforcement where additional amounts and/or types of material may be included to provide support to the mounting structure. In the event that the packaging is mounted onto a vertical surface, the material of the mounting structure may provide sufficient strength so that the mounting structure maintains contact with the vertical surface without bending or deformity of the packaging.

As shown for example in FIG. 1, the packaging 10 may include an elongated arm 12, a first gripping portion 14, a second gripping portion 16, and a mounting structure 18. The first gripping portion 14 may include a protruded area 20. The mounting structure 18 may include an aperture 22. The packaging 10 may further include insert retention portions 24 and an insert 26 maintained therein. The packaging 10 is shown having an inflated ball 40 placed therein.

Figure 2:
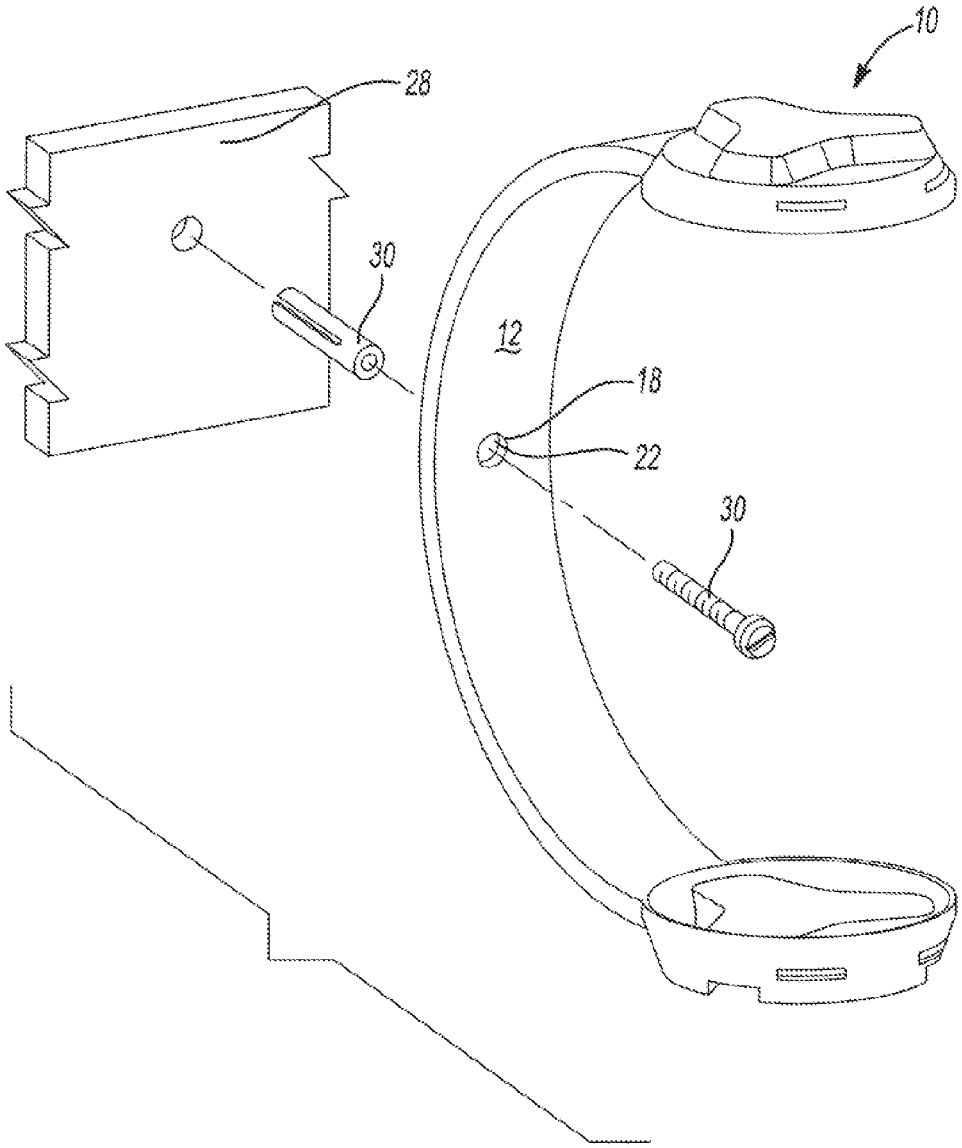
FIG. 2 is a perspective view of the packaging of FIG. 1 shown without a ball placed within the packaging.
Figure 6:
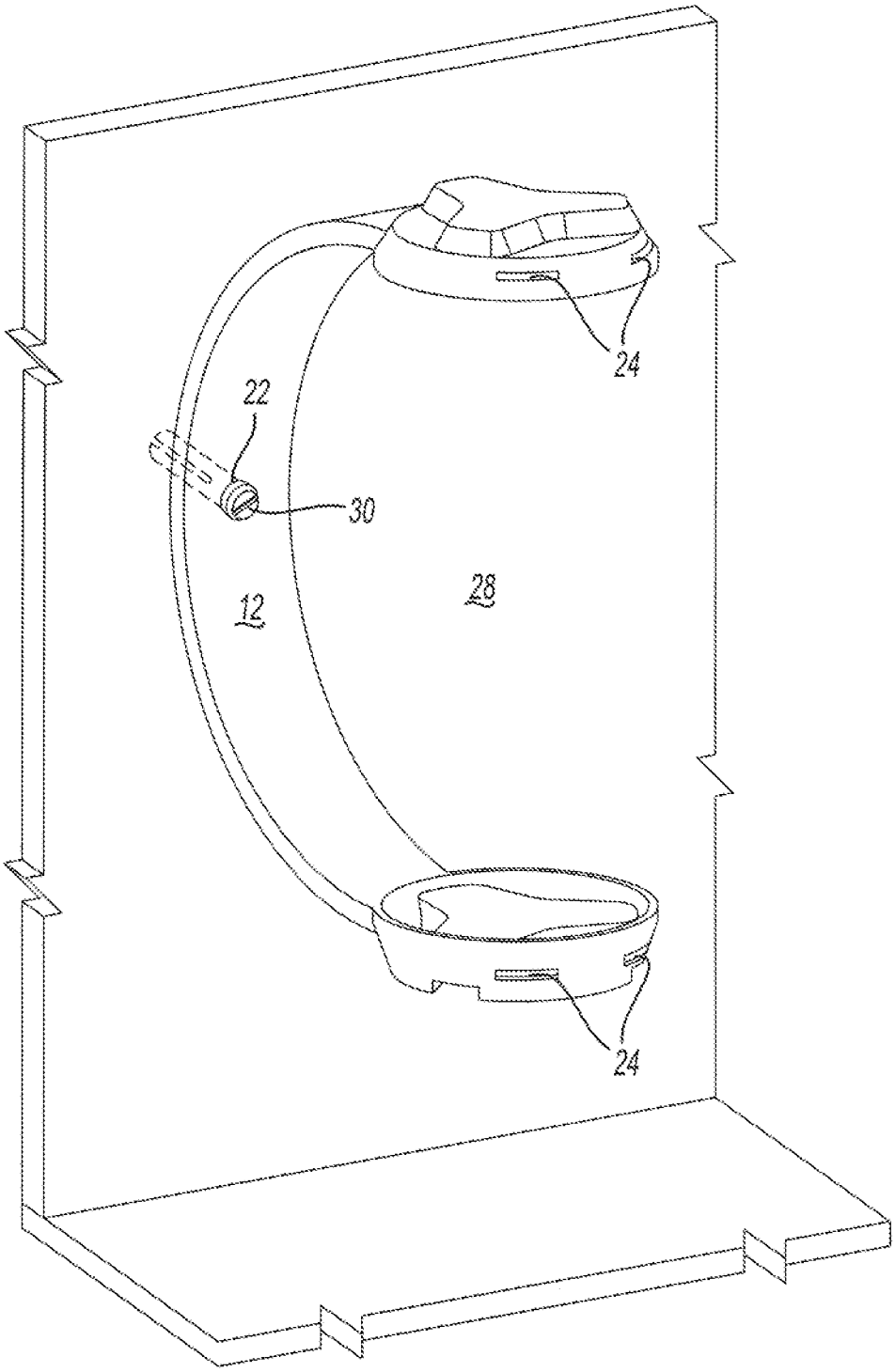
FIG. 6 is a view of the packaging of FIG. 2 shown mounted to a vertical surface.

FIG. 2 shows an illustrative example of how the packaging 10 may be mounted to a vertical surface 28. The elongated arm 12 is shown as being integrally formed with a mounting structure 18, which further comprises an aperture 22. A fastening structure 30 may be placed through the aperture 22 to secure the packaging 10 to the vertical surface 28. FIG. 6 shows an example packaging 10 of the present invention mounted onto a vertical surface 28 via the aperture 22 and fastening structure 30 of the mounting structure 18.

Figure 3:
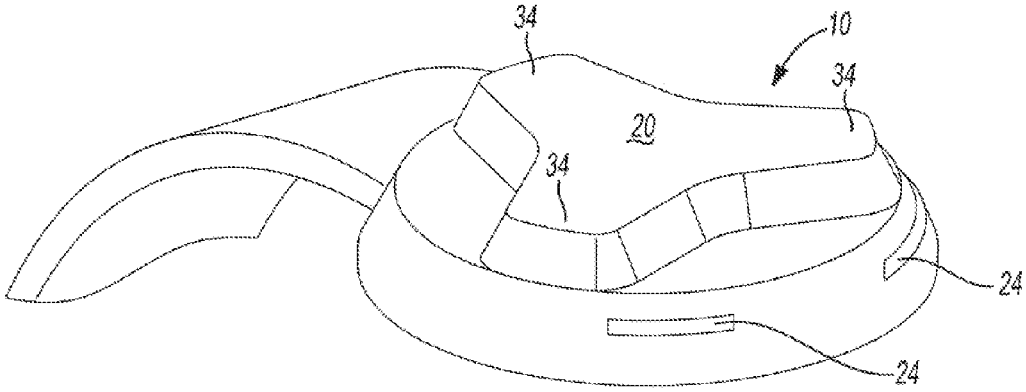
FIG. 3 is a view of an illustrative example of a top gripping portion.
Figure 4:
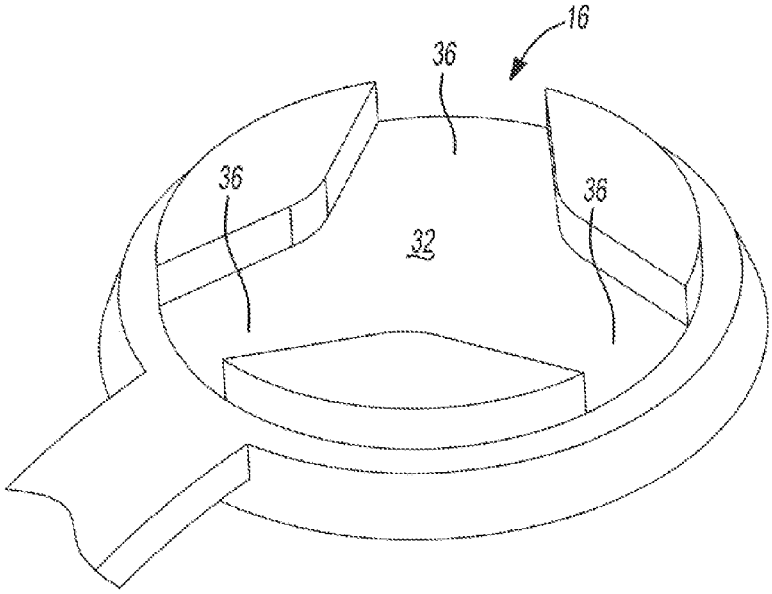
FIG. 4 is a view of an illustrative example of a bottom gripping portion.
Figure 5:
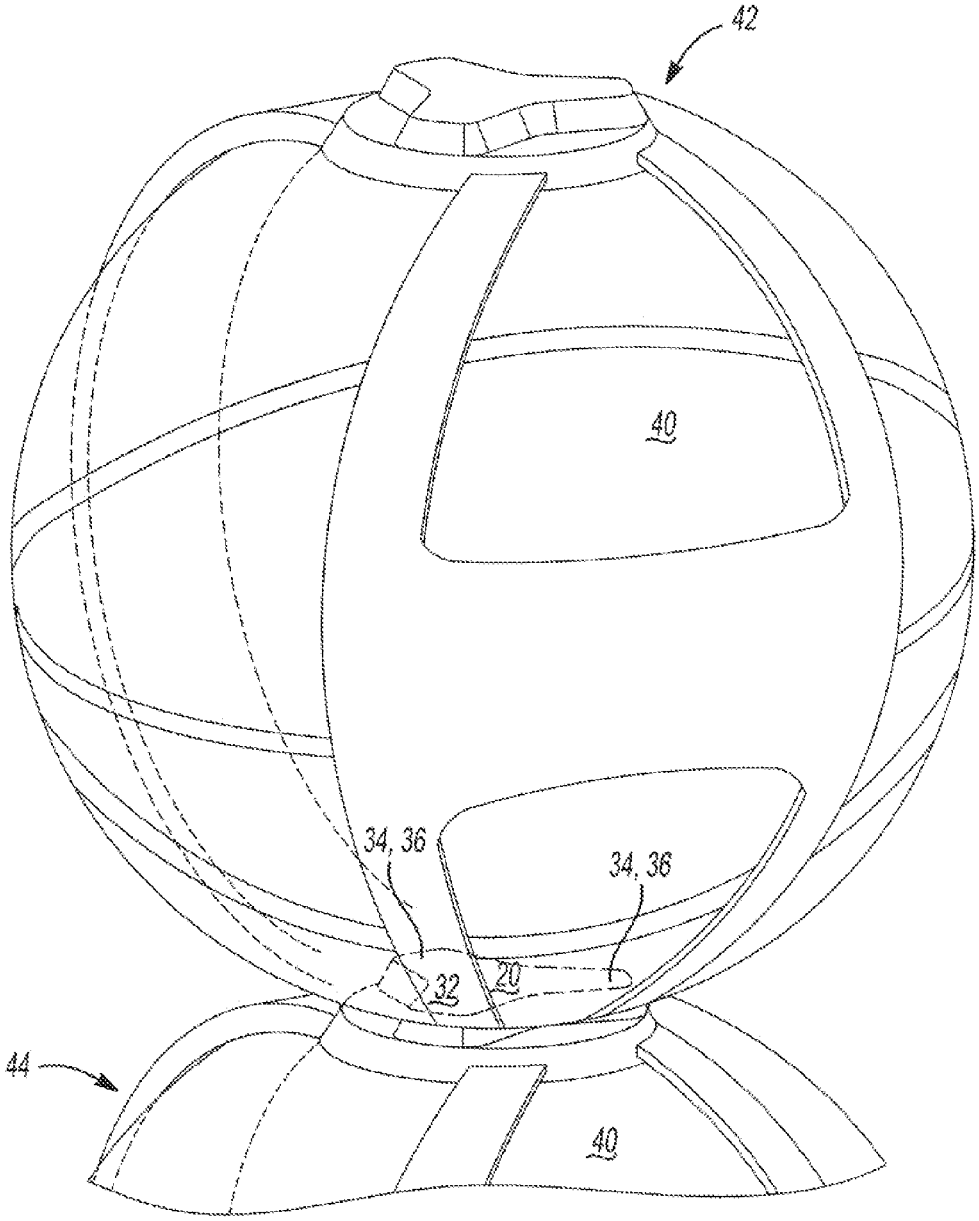
FIG. 5 is a perspective view of an illustrative example of a packaging display showing stacked packagings in accordance with the present invention.

As shown for example in FIGS. 3 and 4, the first gripping portion (e.g., top gripping portion) 14 may include a protruded area 20. The second gripping portion (e.g., the bottom gripping portion) 16 may include a cavity portion 32. The protruded area 20 and cavity area 32 may include one or more extensions 34, 36. FIG. 5 shows two stacked packagings 42, 44 including balls 40 placed therein. The top packaging 42 is shown so that extensions 36 of the cavity area 32 engage the extensions 34 of the protruded area 20 located on the bottom packaging 44.

The packagings described herein may be used to display a customizable rounded article. As a specific example, an inflatable ball may include a customized imprint, drawing, photo, or the like. Thus, a consumer who purchases a customized product may be less likely to use the ball for traditional play and more likely to display the customized product within their home or office. The packagings may be used to display collectible products, such as those containing player autographs, or insignia pertaining to a championship year. A consumer may thus purchase the packaging separately from the product itself, specifically for the purposes of displaying a customized or collectable product.

The nature of the packagings described herein allows for substantial variability in the shipping, storage and display of rounded articles. As previously described, the packagings may be particularly useful for the packaging of sporting equipment, including balls that may be in inflated or deflated form. A ball may be inflated, packaged, shipped and displayed. Alternatively, a plurality of balls may be shipped in a deflated form and packaged along with (or separately from) a plurality of packagings. The packagings may be nestingly stacked so that the deflated balls and stacked packagings inhabit a minimal amount of packaging space. Once the balls and packagings have been shipped, the balls may be inflated and placed within the packagings. The packagings may then be displayed and/or shipped to an additional location if necessary.

As an additional benefit, the packagings may be displayed at one location (e.g., a retail point-of-sale) and later displayed at a second location which may be another retail location or a purchaser's home or business. Thus, the packaging may be configured for attachment to a vertical surface at one location and later attachment to a different vertical surface or a vertical surface at a second location. The packaging may be attached, detached, re-attached multiple times with no damage to the packaging or packaging contents. The nature of the re-attachment capability of the packaging simplifies product returns, allowing a returned product to be immediately placed onto retail displays or shelving without the need for time consuming re-packaging.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It will be appreciated that the above is by way of illustration only. Other ingredients may be employed in any of the compositions disclosed herein, as desired, to achieve the desired resulting characteristics.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. A method for shipping a plurality of balls comprising the steps of:

providing a plurality of balls for shipment at a first location;

packaging each ball in a ball packaging that includes an elongated arm, a top gripping portion having a protruded area and a bottom gripping portion having a cavity formed within that corresponds in shape to the protruded area of the top gripping portion;

stacking the plurality of balls during shipment so that the cavity of a bottom gripping portion engages the protruded area of a top gripping portion of an adjacent ball packaging;

shipping the plurality of balls to a second location; and attaching one or more ball packagings to a vertical surface at the second location.

2. The method of claim 1, further comprising the step of detaching one or more ball packagings from a vertical surface at the second location and attaching the one or more ball packagings to a different vertical surface at the second location.

3. The method of claim 1; further comprising the steps of:

i. detaching one or more ball packaging a vertical surface at the second location;

ii. shipping the one or more ball packagings to a third location; and iii. attaching the one or more ball packagings to a vertical surface at a third location.

4. The method of claim 1, wherein the elongated arm is curved and induces a stress state by partially surrounding the ball.

5. The method of claim 1, wherein the ball packaging includes exactly two gripping portions.

6. The method of claim 1, wherein the ball packaging includes a mounting structure located on the arm between the first and second gripping portions.

7. The method of claim 6, wherein the mounting structure includes an aperture for receiving a fastener located along the arm.

8. The method of claim 1, wherein when attached to the vertical surface, the elongated arm is generally vertically aligned.

9. The method of claim 1, wherein the first and second gripping portions are aligned generally axially with each other along an axis generally parallel to the vertical surface.

10. The method of claim 1, wherein the gripping structures include one or more openings that receive an insert and prevent the insert from dislodging.

11. The method of claim 1, wherein the elongated arm is generally arcuate and has a substantially constant crass-sectional profile between the first and second gripping portions.

12. The method of claim 1, wherein the elongated arm extends no greater than 180° about the ball when inserted.

13. The method of claim 6, wherein the mounting structure is integrally formed in the arm.

14. The method of claim 1, wherein the ball packaging is symmetrical about at least two axes.

15. The method of claim 1, wherein the gripping portions lie in a common plane.

* * * * *

UNITED STATES PATENT AND TRADEMARK OFFICE

CERTIFICATE OF CORRECTION

PATENT NO. : 8,627,952 B2
APPLICATION NO. : 13/084672
DATED : January 14, 2014
INVENTOR(S) : Glinert et al.

It is certified that error appears in the above-identified patent and that said Letters Patent is hereby corrected as shown below:

In the Claims

Column 10
Claim 3, Line 5, Delete “ball packaging a”, insert --ball packagings from a--
Claim 11, Line 32, Delete “constant crass-sectional”, insert --constant cross-sectional--

Signed and Sealed this
Twentieth Day of May, 2014

Michelle K. Lee

Michelle K. Lee
*Deputy Director of the United States Patent and Trademark Office*